US008397966B2

(12) United States Patent
Kim

(10) Patent No.: US 8,397,966 B2
(45) Date of Patent: Mar. 19, 2013

(54) SYSTEM AND METHODS FOR CORDAGE STORAGE/DEPLOYMENT AND ARTICLES

(76) Inventor: Douglas Shin Kim, Oakland, CA (US)

( * ) Notice: Subject to any disclaimer, the term of this patent is extended or adjusted under 35 U.S.C. 154(b) by 314 days.

(21) Appl. No.: 12/799,820

(22) Filed: Apr. 30, 2010

(65) Prior Publication Data

US 2010/0276320 A1 Nov. 4, 2010

Related U.S. Application Data

(60) Provisional application No. 61/215,134, filed on May 1, 2009.

(51) Int. Cl.
*A45F 3/00* (2006.01)

(52) U.S. Cl. ..... 224/660; 206/388

(58) Field of Classification Search ..... 206/388, 206/495, 49, 479; 224/660; 2/228; 242/588.3; 434/83; 223/106
See application file for complete search history.

(56) References Cited

U.S. PATENT DOCUMENTS

| | | | | | |
|---|---|---|---|---|---|
| 710,126 | A * | 9/1902 | Tressel | 206/388 |
| 2,082,346 | A * | 6/1937 | Lavenson | 428/131 |
| 2,646,196 | A * | 7/1953 | York | 223/106 |
| 2,878,013 | A * | 3/1959 | Piodi | 267/69 |
| 3,371,351 | A * | 3/1968 | Allain | 2/338 |
| 4,121,711 | A * | 10/1978 | Bolanowski | 206/63.3 |
| 4,177,522 | A * | 12/1979 | Auburn | 2/338 |
| 4,662,517 | A * | 5/1987 | Wirth | 206/388 |
| 4,790,463 | A * | 12/1988 | Hansen | 224/680 |
| 4,978,008 | A * | 12/1990 | Dalbo et al. | 206/574 |
| 5,299,325 | A * | 4/1994 | Kamber et al. | 2/338 |
| 5,431,320 | A * | 7/1995 | Hash | 224/258 |
| D375,832 | S * | 11/1996 | Miller | D3/23 |
| 6,516,920 | B1 * | 2/2003 | Schafler | 182/70 |
| 6,712,250 | B2 * | 3/2004 | Vigny | 224/640 |
| 2002/0157979 | A1 * | 10/2002 | O'Connor | 206/388 |

* cited by examiner

*Primary Examiner* — Nathan J Newhouse
*Assistant Examiner* — Matthew Theis

(57) ABSTRACT

Methods and systems are disclosed for storing cordage on a flexible carrier containing a plurality of holes, the cordage being quickly and easily removable from the flexible carrier when a temporary securement securing an end of the cordage is disengaged and an end is pulled. The flexible carrier can be a cordage storage article, a strap, a panel, a belt, a piece of clothing, a piece of a backpack, carry bag, tent, etc.

20 Claims, 14 Drawing Sheets

SYSTEM AND METHODS FOR CORDAGE STORAGE/DEPLOYMENT AND ARTICLES

This application relates to systems and methods for the storage of cordage, and deployment of same, along with useful articles made with the invention. This application claims the benefit of provisional patent application No. 61/215,134, filed 2009 May 1 by the present inventor.

BACKGROUND

Storing and transporting cordage, used hereafter to describe thin string or twine with a diameter of 2 mm or less, cord with a diameter of 2-4 mm, rope with a diameter of 4-15 mm and thick rope with a diameter in excess of 15 mm, presents some challenging problems. The problems include; that the cordage often becomes tangled when stored or in transit, and it can take considerable time to untangle the cordage before it is usable. Another problem is that conventionally stored cordage takes up room and therefore limits the contents of the duffel, bag, backpack, or other container storing the cordage. Additionally, if the cordage becomes loose and tangled in a container (e.g., bag or backpack), it may "snare" other objects in the container.

U.S. Pat. No. 3,576,297 to Cowart (1971) discloses a holder for water-ski rope whereby the rope is wound around the holder. This kind of "winding rope holder" effectively prevents the stored cordage from becoming tangled once it is wound onto the holder. However, the rigid nature of the holder makes it less desirable to pack in a backpack than a flexible holder would be.

A more minimalist, flexible means of storing cordage is disclosed in U.S. Pat. No. 6,345,418 to Betrand et al, 2002. This cordage storage method lacks significant rigidity and is thus more suited to being carried in a backpack than a rigid "wind-up frame". However, the exposed cordage may become entangled with other items, e.g., in a backpack or bag, because the stored cordage is not protected from interacting with items it comes in contact with. Additionally, deployment of the cordage from this method requires unfastening fasteners and unwrapping the cordage which can be problematic in an emergency situation. Finally, there is no mechanism to prevent the cordage from becoming untangled once it is released from this "rope hook".

Rope and throw bags are designed to feed out rope when an end of the rope is pulled, or when the bag is thrown, e.g., to a drowning victim. Examples of these devices include U.S. Pat. No. 6,659,823 to Mosna et al, 2003, and U.S. Pat. No. 4,713,033 to Cameron, 1987. While cordage is packed in these dispensers and will deploy rapidly, rigid components make them rigid. Additionally significant practice or expertise and perhaps even special tools may be required to successfully re-pack the cordage so it can be deployed quickly and predictably when next needed.

U.S. Pat. No. 5,743,396 to Short et al, 1998, discloses a method/system to store and deploy rope or line using a number of tubular members. This arrangement provides for the rapid deployment of thick rope, but this method is intended for thick rope used for an emergency tow pack for sea-going vessels and would not be suitable for cordage of small diameters, e.g., under about 10 mm. Further, the rigidity of the tubular members makes this method/system unsuitable for lightweight, compact, and convenient transport articles.

Another method intended to deploy rope used in rappelling is disclosed in U.S. Pat. No. 4,662,517 to Wirth, 1987. This method/system is designed to prevent the stored cordage from becoming entangled when an elongated flexible panel is rolled up and secured, but once the elongated flexible panel is unrolled, the loops of cordage are susceptible to entanglement if they come in contact with other objects or material. This system is also intended for thicker cordage (diameters usually in excess of 10 mm) that is capable of bearing a climber and is not readily adaptable to cordage of smaller diameters, e.g., 4 mm and less. Aesthetically, when stored in the rolled panel, the color and pattern of the cordage is hidden and can't be seen or appreciated.

Two patents incorporating a rope carrying function into an article of clothing are U.S. Pat. No. 6,275,994 B1 to Lewis et al (2001) and U.S. Pat. No. 6,012,167 to De Rosa et al (2000). Both disclose garments for use by firefighters, rescue workers, forestry workers and similar occupations. They differ in that the former uses elastic bands inside the garment to separate the cordage, whereas the later is essentially one long "pocket" that circles the wearer's waist. As such the latter patent includes nothing inside the pocket to prevent the cordage from fouling or becoming entangled on itself. Both methods place the cordage inside the garment and thus create two potential problems. 1) The heavy stored cordage can shift the center of mass of the wearer as he/she moves about, causing them to become off-balanced. 2) While the cordage is being deployed it may pull the wearer of the garment in an undesirable fashion causing them to lean or fall. Embodiments wherein the rope is stored in part of the garment also inherently mean that if the wearer takes off the garment (if for example it becomes too warm to wear the coat) they are without access to the cordage on their person (unless they are carrying the garment by hand). Or put another way, if one desires to have continual access to the cordage stored by these methods, they must continue to wear or carry the garment no matter how uncomfortable that may become. Both of these methods also hide the cordage from view.

Two patents disclose using cordage as part of visible utility or survival belts, worn for special purposes. U.S. Pat. No. 4,184,617 to Lyon, 1980, discloses a "survival belt" comprised of cordage run through a plurality of holes in two separate parts of what amounts to a "buckle". This buckle incorporates a hatchet head with various survival implements attached. U.S. Pat. No. 4,177,522 to Auburn, 1979, discloses a survival belt of woven cordage, the belt suitable for removal and rapid unraveling to produce a continuous single strand, however the belt looses its use as a belt when the cordage is needed and must be rewoven, a difficult task, to re-stow the cordage after use. While both of these inventions are flexible and effectively display the cordage, they suffer one major flaw as an article of clothing. Namely, once the cordage has been deployed, the wearer no longer has a belt, or other functional article, to keep their pants up, for holding various pouches or articles, etc. Additionally, to deploy the cordage the user must remove the belt and disassemble it. The time involved in doing so may be excess in an emergency or survival situation, and with one of the inventions the act of restoring the belt is very complex and very time consuming.

Flexible cordage holders that would conform to irregular shapes and/or compress more than existing rigid holders when other adjacent items are pressed against them are nonexistent, but would be very useful. Also, the rigidity of prior art holders make them unsuitable for incorporating into many useful articles. Most, prior art rope, etc. holders require the operator to manipulate the holder to release the rope in small increments at a time until the rope is completely deployed and the deployment of the cordage is not a smooth, continuous action, but often jerky and halting. Present devices that help keep the cordage from getting tangled also prevent it from being deployed rapidly. While some holders have been specifically created to deploy cordage rapidly in emergency situations, they suffer one or more of the above limitations.

SUMMARY

The invention includes systems and methods for storing and quickly deploying cordage, the systems comprising flexible cordage storage items including, but not limited to, articles of clothing wearable by the user and articles of luggage that can be easily carried by the user, both allowing the stored cordage to be readily available for use by the user. Additionally, the invention can be packed as a separate item so that the stored cordage will not become tangled while transported.

Further, the cordage system can be easily and rather quickly restored following deployment of the cordage to be ready when again use of the cordage is needed. The systems of the invention comprise a flexible carrier such as a flexible strap or flexible panel comprising a plurality of closely spaced apart holes therein, a length of cordage passing through the plurality of holes and optionally 1) an optional securement for at least one loose end of the cordage, and 2) optional reinforcements of the holes. The flexible carrier, e.g. a strap or flexible panel can be an article of clothing including but not limited to a belt, such as a utility belt and preferably a belt of the type to be held within belt loops on trousers, shorts, etc., a vest, jacket or bandolier. By closely spaced apart is meant that the centers of the holes are no farther apart than about 150 mm, typically no farther apart than about 85 mm, more typically no farther apart than about 26 mm and most typically within the range of about 26 mm to about 14 mm, such as within the range of about 38 mm to about 14 mm or even about 150 mm to about 14 mm. The lengths of the cordage between holes, i.e. the loops between holes, does not exceed about 128 mm, typically about 76 mm, more typically about 25.4 mm, and most typically about 19 mm.

As used herein, cordage includes the following; string or twine with a diameter of 2 mm or less, cord with a diameter of 2-4 mm, rope with a diameter of 4-15 mm and thick rope with a diameter in excess of 15 mm and up to 280 mm. The shape of the holes can be numerous including, but not limited to, circles, part(s) of a circle, racetrack, semi-circle, rectangle, oval, square, square with, triangular, multiple triangular, parallelogram, trapezoidal, polyangular, etc. The corners of the shapes can be angular, square (where possible) or radiused. The size of the holes will often depend upon the diameter of the cordage to be stored, but typically be large enough for the cordage to move through the holes with little resistance. For example, when the cordage has a diameter of about 3 mm, the round holes can have an opening that permits at least about 0.5 mm clearance around most or all of the periphery of the cordage. By most is meant at least about 45 or 50% of the periphery. Generally the clearance will extend around at least 2.5%, more typically about 10%, even more typically up to at least 25% and most typically 45 or 50% around the periphery of at least some of the holes, usually the majority of the holes and up to all of the holes that contain cordage, but the clearance depends on several factors. The amount of clearance and the extent of the clearance around the periphery will depend upon the shape of the holes, the cross section shape of the cordage and the ease with which the user wants to use to deploy the cordage. Further, when it is desirable that the flexible carrier and holes provide substantial resistance to the deployment of the cord, such as for lowering a person down a steep slope or down in mid-air, the cordage will fit snugly or tightly in at least many of the holes to provide the necessary resistance to deployment. Hole reinforcements (e.g., grommets and/or shoe eyelets) may also be used to provide desired resistance to deployment of the cordage.

The cross-section of the cordage will usually be a circle, but need not be. The holes can be formed by any means such as hole punching, piercing, and optionally by placing grommets to secure holes where the holes might tend to close in or close up, and to reinforce the carrier material, as well as provide desired resistance to deployment of the cordage. It is not necessary that the cordage pass through all of the holes, but that is preferable for most economical and efficient use. It is permissible if the cordage passes through only at least 80% of the holes, more typically at least 85% of the holes, even more typically at least 90% of the holes and most typically at least 95% of the holes with 98-100% of the holes being used being preferred. By most of the holes is meant at least about 80% of the holes.

The flexible carrier including straps or panels can be made of most any flexible material including, but not limited to, leather, polymers, metal, non-woven and woven fiber and/or strands of fibers, of any material, in the form of cloth, fabrics and scrim. The flexible carrier can be made from a single layer or two or more layers of such material. The flexible carrier including the straps or panels can be part of useful articles having other functions like belts, to be secured in belt loops of an article of clothing, or worn over the belt loops as a "duty belt" (e.g., like those worn by police and military personnel), straps of backpacks, handles for luggage like duffel bags, satchels, etc., and the panels can be part of hand luggage, backpacks, hats, jackets, vests, bandoliers, shorts, pants, etc.

The invention also includes a method of making a cordage storage article by threading or lacing a continuous length of cordage through all or at least most all of a plurality of holes in a strap, strip or panel of flexible material and securing at least one end of the cordage from pulling out of the holes, the threading being such, and the size of the holes relative to the diameter of the cordage being such that when the secured end is released and pulled, the entire cordage can easily and quickly be pulled from the strap, strip or panel.

Securing at least one end of the cordage can be achieved in two basic ways; 1) with a device such as, but not limited to; piece of hardware (like a snap hook or cord lock), a paper clip, piece of tape, small ring (with a diameter larger than that of the hole), a safety pin, small ring (with a diameter larger than that of the hole), or even a knot tied in the cordage. Ideally the device used to secure at least one end of the cordage can be quickly and easily removed or disengaged by the user with only one hand. 2) by simply lacing or weaving the end of the cordage into one or more holes on one side of the panel. Ideally these holes are easily distinguishable from other holes in the carrier so the user can identify them solely by touch or location. Furthermore, it is most desirable if the user can easily extract the end of the cordage from these holes using only one hand.

The article can be an item of clothing, a part of a piece of hand luggage, and part of a tent or a part of other outdoor activity products. The manner of threading or lacing the cordage through the holes is simple, similar to lacing a shoe or boot, but taking slightly more time due to the larger number of holes. The lacing can be done without the use of any tools and usually on the spot when the cordage is no longer needed off and out of the storage article. More than one pattern of lacing can be used as will be described below.

Some advantages of the invention compared with prior art include, but are not limited to: Cordage is stored in and deployed from a non-rigid, flexible "carrier" component. This component "packed" with the stored cordage therefore is not rigid and can easily be packed in irregular spaces next to or under heavy objects. Once cordage is correctly placed in the carrier it is unlikely to become snagged on other objects or entangled with itself. This "tangle-resistant" quality is maintained when the stored cordage/carrier combination is worn as an article of clothing, or packed in a bag or container. The cordage can be easily and rapidly deployed as a single, continuous strand by the user when desired. Accidental deployment of the cordage is prevented by the methods described below.

In all embodiments once the cordage is deployed, the user still retains and has use of the underlying layer of carrier material. This is especially beneficial in the embodiment of this article as a belt, worn in pant/shorts, etc. belt loops, because the carrier will continue to hold up the users' pants after the cordage has been deployed. Repacking cordage pack into the carrier (after the cordage has been deployed) is simple and can be done easily by the user without special tools or training. This makes the article user-friendly, re-useable time after time and "non-disposable after first use" item.

The carrier and method disclosed below can be constructed to accommodate cordage diameters as narrow as 2 mm to one as thick as 15 mm or more. Once packed in a carrier worn as an article of clothing the stored cordage is readily visible and can be appreciated by all who see its color, pattern, design, and light reflecting ability (if any).

Modern "kernmantle" ropes and cords, (i.e. ones with a woven exterior sheath, mantle, surrounding an inner core, the "kern) are increasingly colorful, beautiful and functional. Some even glow in the dark, or reflect light, and many have patterns that look like neon "snake-skin". It could be aesthetically pleasing, perhaps even fashionable, to incorporate a cordage storage function into articles of clothing. In so doing the wearer can not only express their sense of "style", but also keep a length of cordage on their person ready for use when needed. And to the extent that the cordage may reflect light (e.g., back to a car headlamp from cordage being carried or worn as part of an article of clothing by a person traveling at night in the dark) the visibility of the cordage to oncoming vehicles may also add to the users' safety.

When the word "about" is used herein it is meant that the amount or condition it modifies can vary some beyond that stated so long as the advantages of the invention are realized. Practically, there is rarely the time or resources available to very precisely determine the limits of all the parameters of one's invention because to do so would require an effort far greater than can be justified at the time the invention is being developed to a commercial reality. The skilled artisan understands this and expects that the disclosed results of the invention might extend, at least somewhat, beyond one or more of the limits disclosed. Later, having the benefit of the inventors' disclosure and understanding the inventive concept and embodiments disclosed including the best mode known to the inventor, the inventor and others can, without inventive effort, explore beyond the limits disclosed to determine if the invention is realized beyond those limits and, when embodiments are found to be without any unexpected characteristics, those embodiments are within the meaning of the term "about" as used herein. It is not difficult for the artisan or others to determine whether such an embodiment is either as expected or, because of either a break in the continuity of results or one or more features that are significantly better than reported by the inventor, is surprising and thus an unobvious teaching leading to a further advance in the art.

DETAILED DESCRIPTION OF THE BEST MODE AND OTHER EMBODIMENTS

Figure 1:
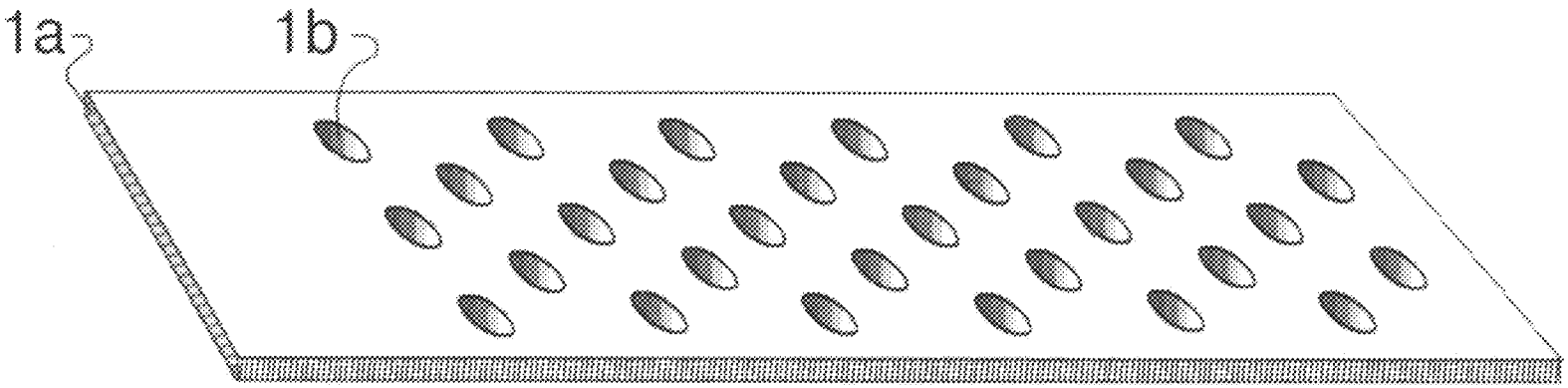
FIG. 1 shows a small, flat strip or belt of material as the carrier containing a plurality of holes.
Figure 2:
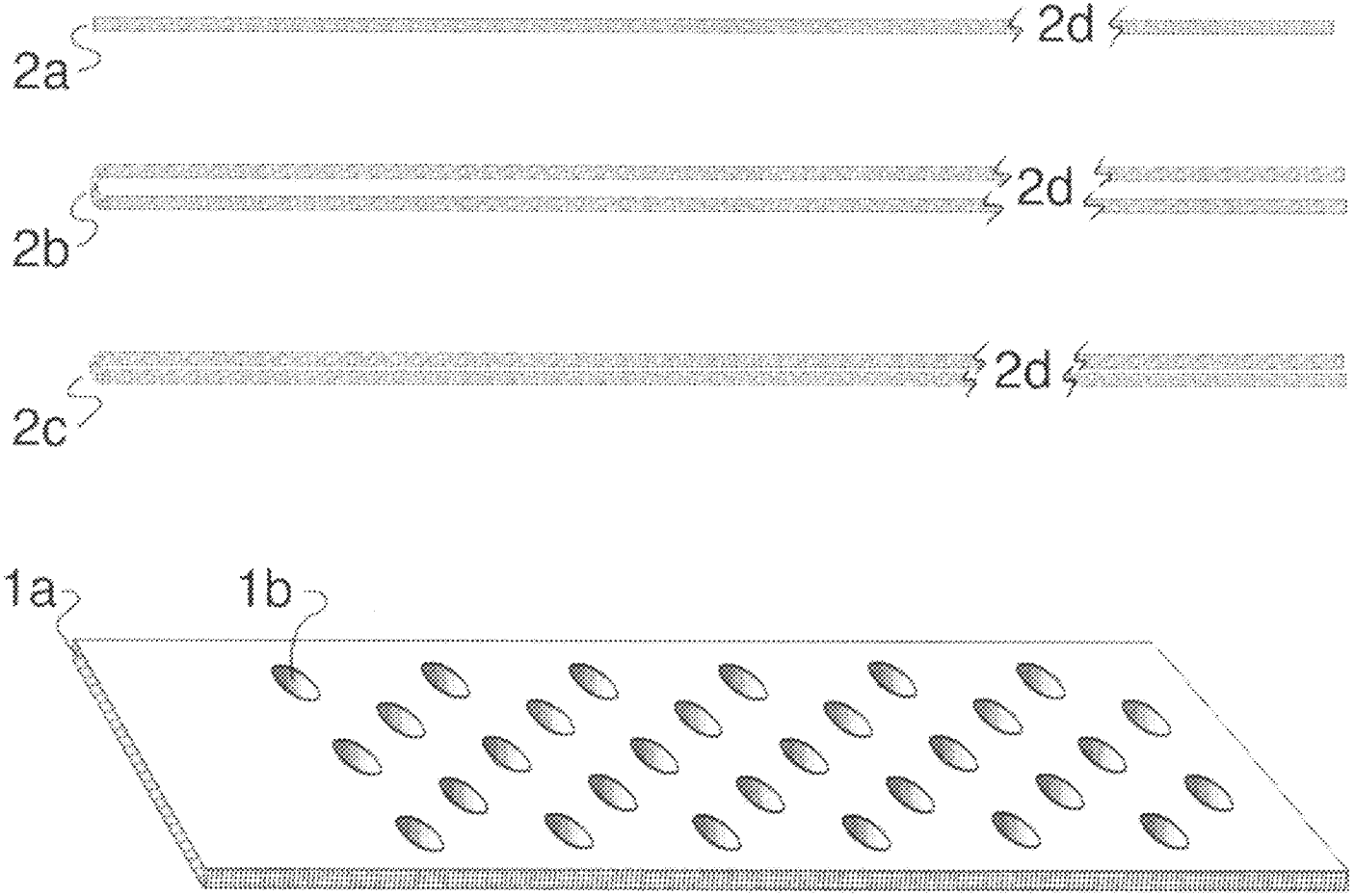
FIG. 2 shows the carrier of FIG. 1 below three embodiments of cordage to be stored in the carrier.
Figure 3:
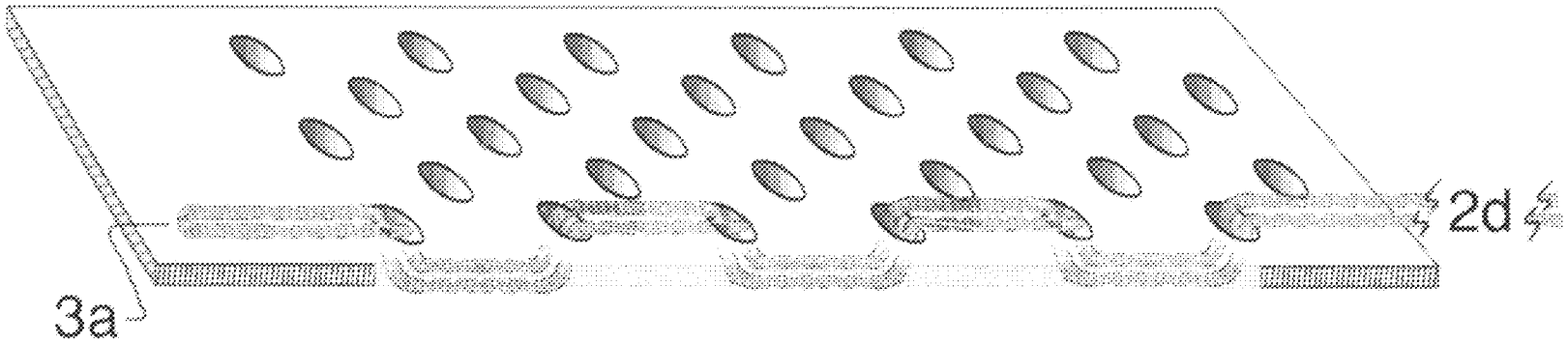
FIG. 3 is a cutaway view of the cordage as it is woven through the lowest row of holes in the carrier of FIG. 1
Figure 4:
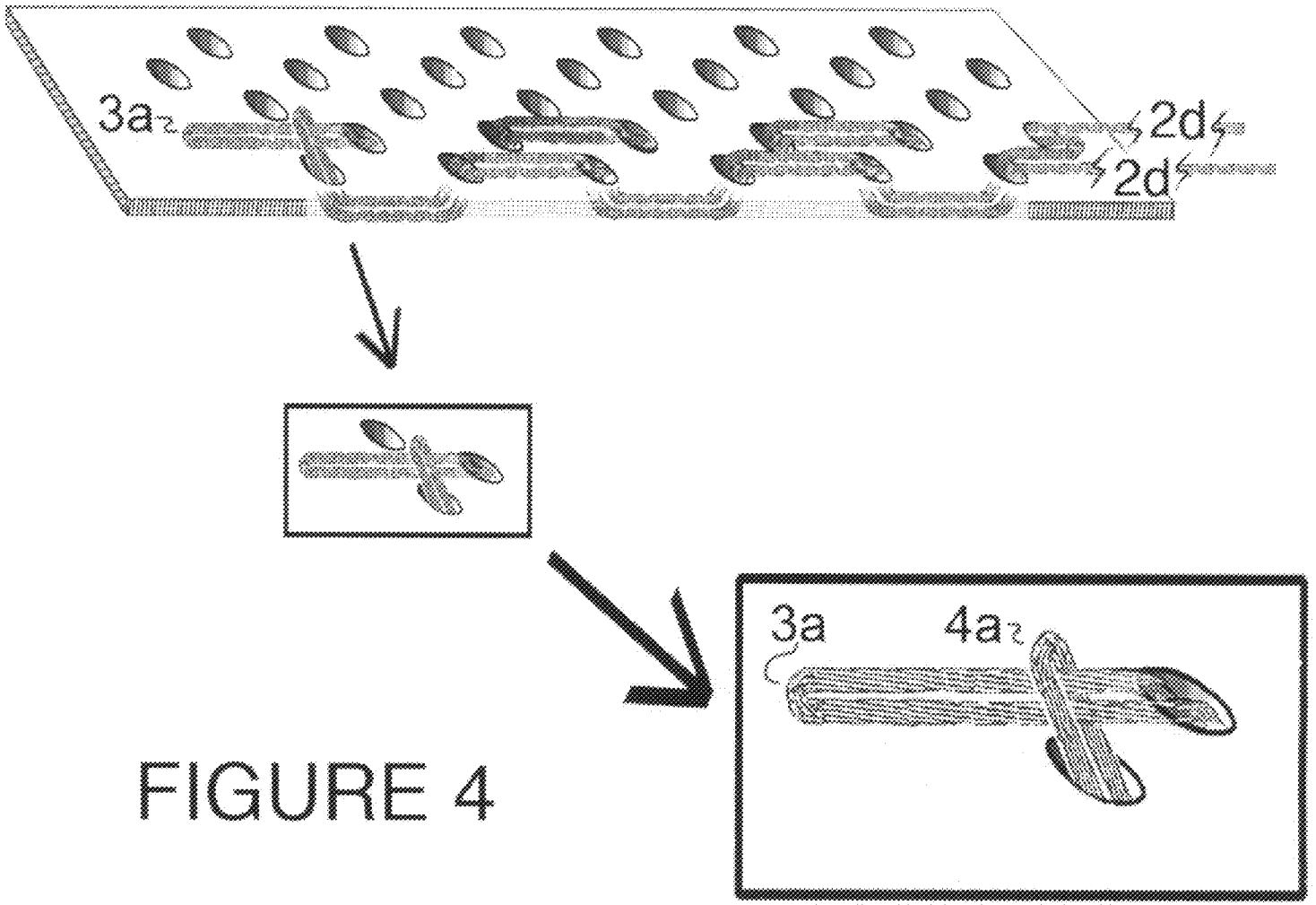
FIG. 4 shows a second row of holes with the cordage passing through the holes and details the left end of the first row of stored cordage repositioned to allow the left end of the second row of stored cordage to pass through FIG. 5 shows all rows of the carrier filled with the stored cordage, with the left ends of the cordage interposed to prevent them from unraveling.
Figure 5:
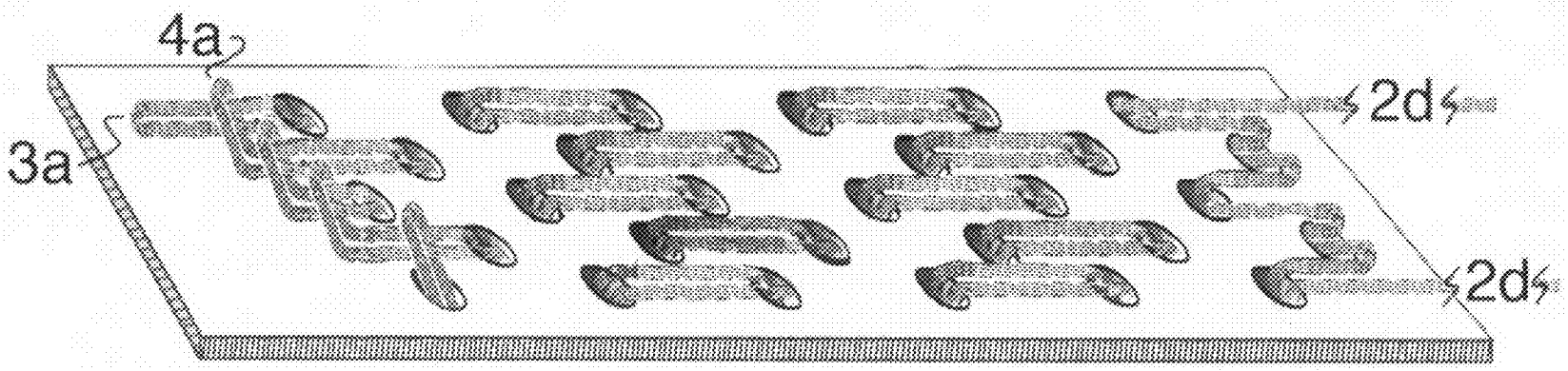

The flexible carrier 1 comprises one or more layers of flexible material 1*a*, with a plurality of holes 1*b*, one embodiment of a flexible carrier being shown in FIG. 1. Cordage 2*a*, see FIG. 2, to be stored and deployed in the flexible carrier 1 is initially loosely looped 2*b* so that it forms a long "U" shape. The loop is tightened, minimized as the two strands of cordage are brought together, preferably as close as possible to form a tightly looped double strand 2*c*. The tightly looped double strand 2*c* of cordage makes the two now touching strands have a combined thickness that is, in this embodiment, about 90% to 95% of the diameter of the holes 1*b*, as shown in FIG. 2. As shown in FIG. 3 the loop end 3*a* of the cordage is Laced through the holes so that it weaves its way above and below the surface of the carrier 1*a*. Care should be taken to keep the strands flat and the strand going into the next row on top. The "hidden" cordage is shown beneath the flexible carrier 1*a* in the cutaway portion view in FIG. 3. Breaks indicating cordage length is variable are indicated as 2*d*. The second row is laced just as the first row, however the loop end 3*a* is now formed using only the top strand from the first row. The new loop end 3*a* is passed through the previous loop end 4*a* as shown in FIG. 4. The user then gently tightens the upper strand from the first row and the lower strand from the second row, ensuring that the cordage is packed flat and smooth against the carrier 1*a*. The lacing/weaving process is repeated until all the rows of holes are packed and the final loop end 3*a* is at the top row opposite the loose strands (shown in FIG. 5 in an upper corner). The final loop end 3*a* may be secured to the carrier using any suitable technique and/or securement. In the embodiment shown in FIG. 6, a conventional piece of hardware such as snap hook (a variety of which are available from the Tandy Leather company) shown as 6*a*. Any type of securing device can be used, even a paper clip, key ring, safety pin, tape, cordage lock (like those used to tighten hoods and bottoms of jackets, etc.). Alternatively, the loop end 3*a* may be secured by weaving it through a set of holes that run, are perpendicular to the rows of holes, see FIG. 7 which shows this means of securement and includes a cut-away view of final end of the loop 7*a* hidden below the carrier surface.

Figure 6:
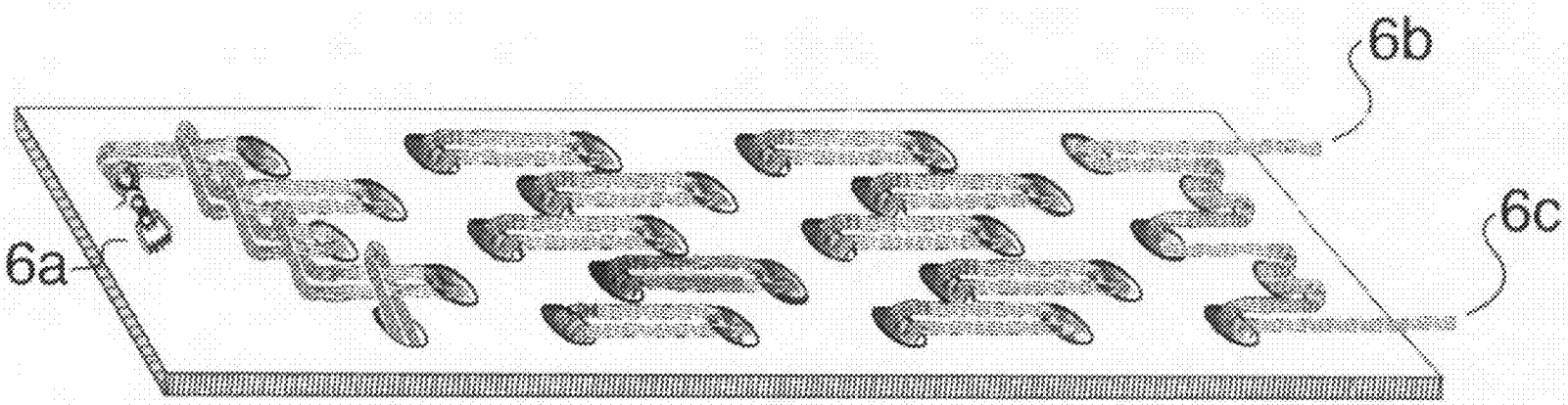
FIG. 6 shows the left end of the top row of stored cordage secured by a piece of securement hardware.
Figure 7:
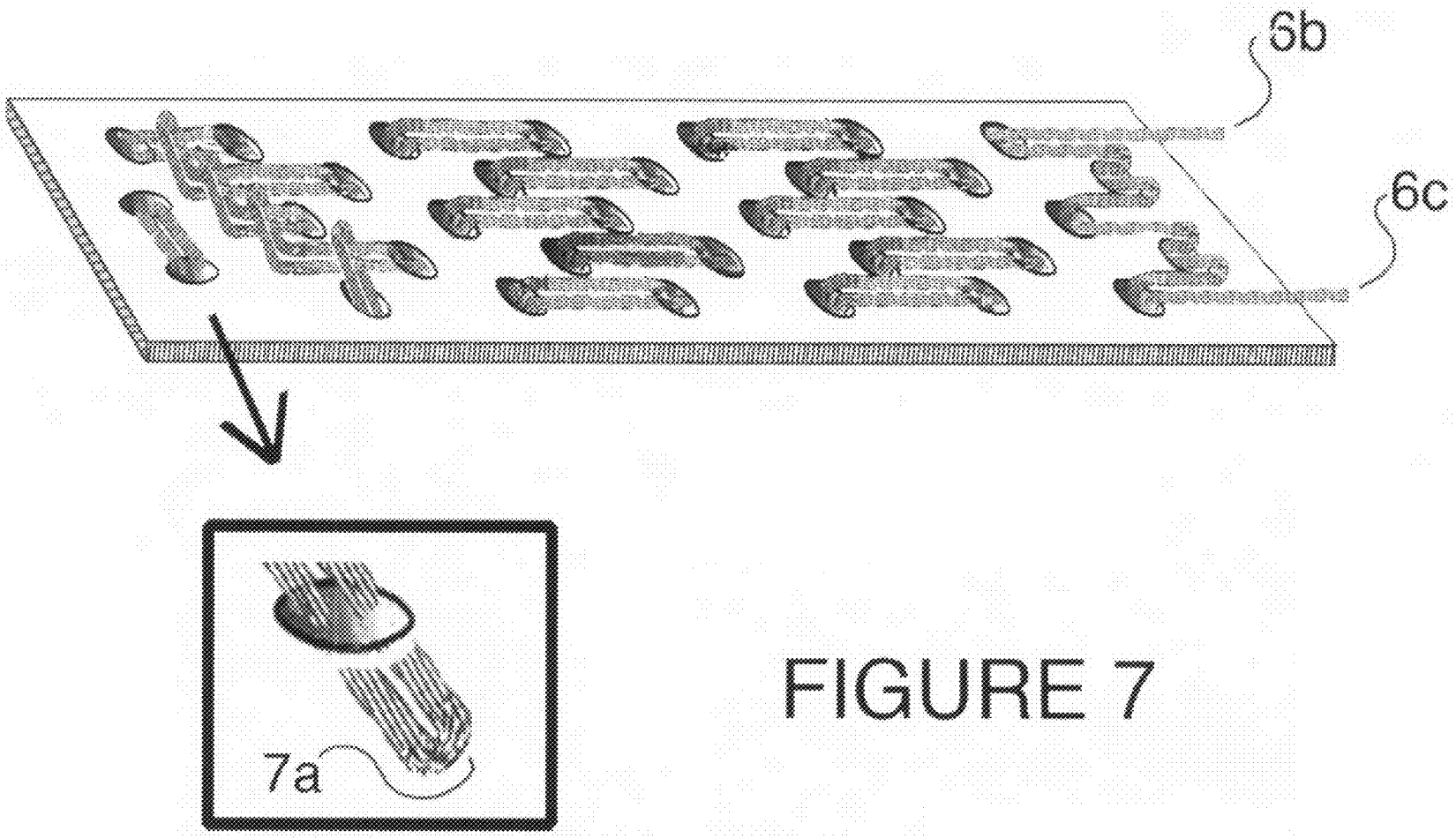
FIG. 7 shows the left end of the top row of stored cordage secured by weaving it into a set of holes that are perpendicular to all other holes.

Deployment of the cordage simply requires the user to detach the loop end 3*a* from the hardware securement, e.g. as show in FIG. 6, or simply to pull it completely out of the set of securement holes so that the final end loop 7*a* can move freely. The user then pulls on a pull end 6*b*. The amount of force exerted on the pull end 6*b* depends on how quickly the user wants the cordage deployed, but is usually no more than 25 newtons, and usually not less than 2 newtons, but can be higher in the embodiments intended to be used to control or limit the lowering rate of a person down a steep slope or down vertically.

Figure 8:
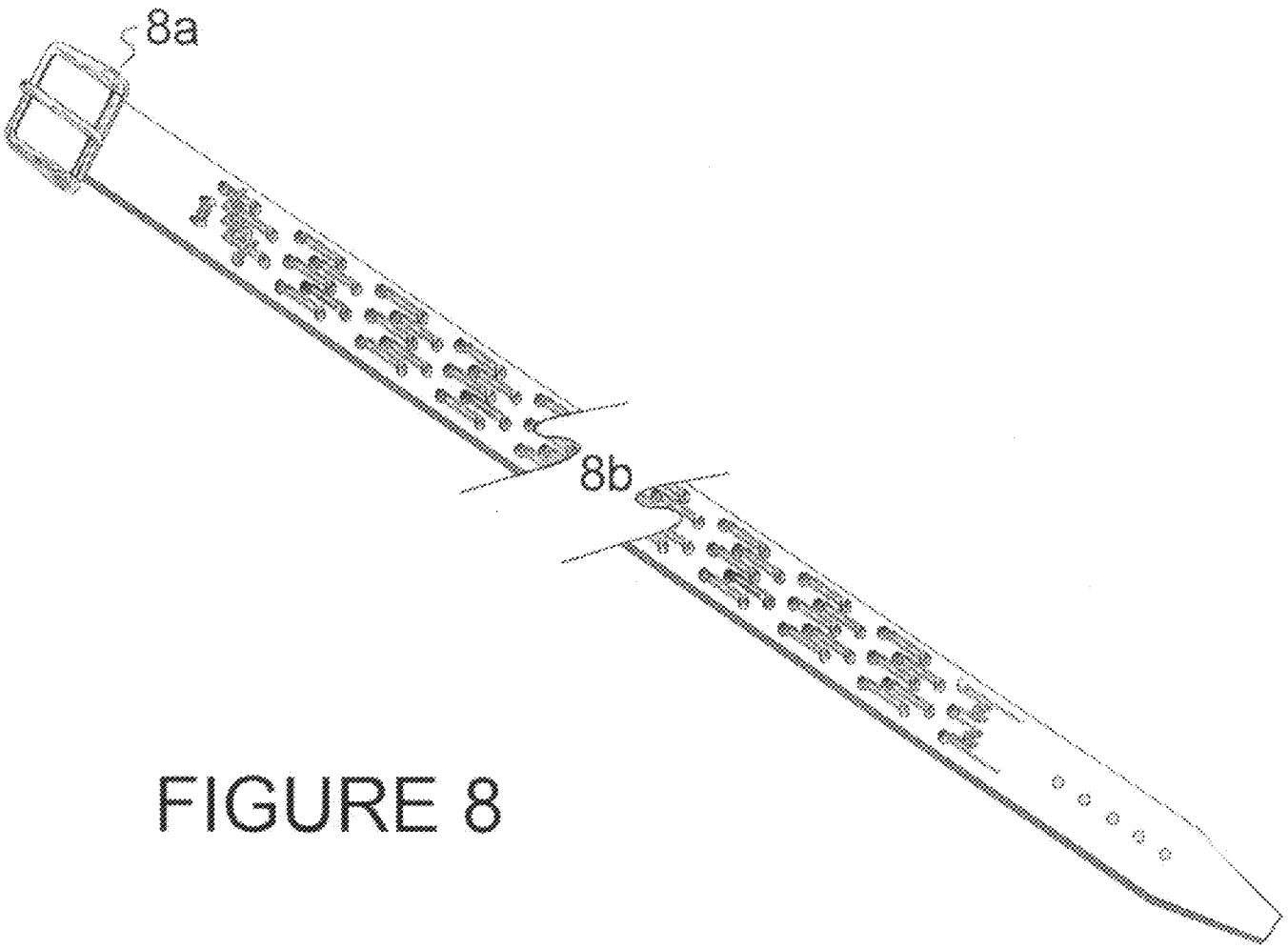
FIG. 8 shows the embodiment of this article as a belt used to hold up the users' pants.

One clothing embodiment of the cordage storage invention is very useful as a belt, either worn in belt loops on a pair of pants or shorts to keep same up, as shown in FIG. 8, or outside belt loops in a fashion similar to a "duty or utility" belt worn by police, military personnel, electricians, etc. to attach equipment to and/or on. As an article of clothing, worn under pant belt loops, this embodiment can utilize any conventional buckle device 8*a*, such as the type of buckle shown in FIG. 8, but not limited to this type. Stored cordage can be deployed while the user is wearing the belt, without removing the belt or its function.

Deployment of the cordage can be achieved in at least three ways. 1) If the final end 7*a* is secured by being woven into the carrier, the user frees the final end 7*a* (see FIG. 7) with one hand and then pulls on the pull end 6*b* with the other. 2) If the loop end 3*a* is secured by a piece of hardware 6*a* or other device 6*a*, the user removes this securement hardware 6*a* or device 6*a* with one hand and then pulls on the pull end 6*b* with the other. 3) The final end 7*a* or loop end 3*a* can be removed as needed and describe above, then the users secures pull end 6*b* to a stationary object (like a tree or rock) and then moves away from same. In this instance the cordage is deployed as the users moves away from the stationary object.

Figure 9:
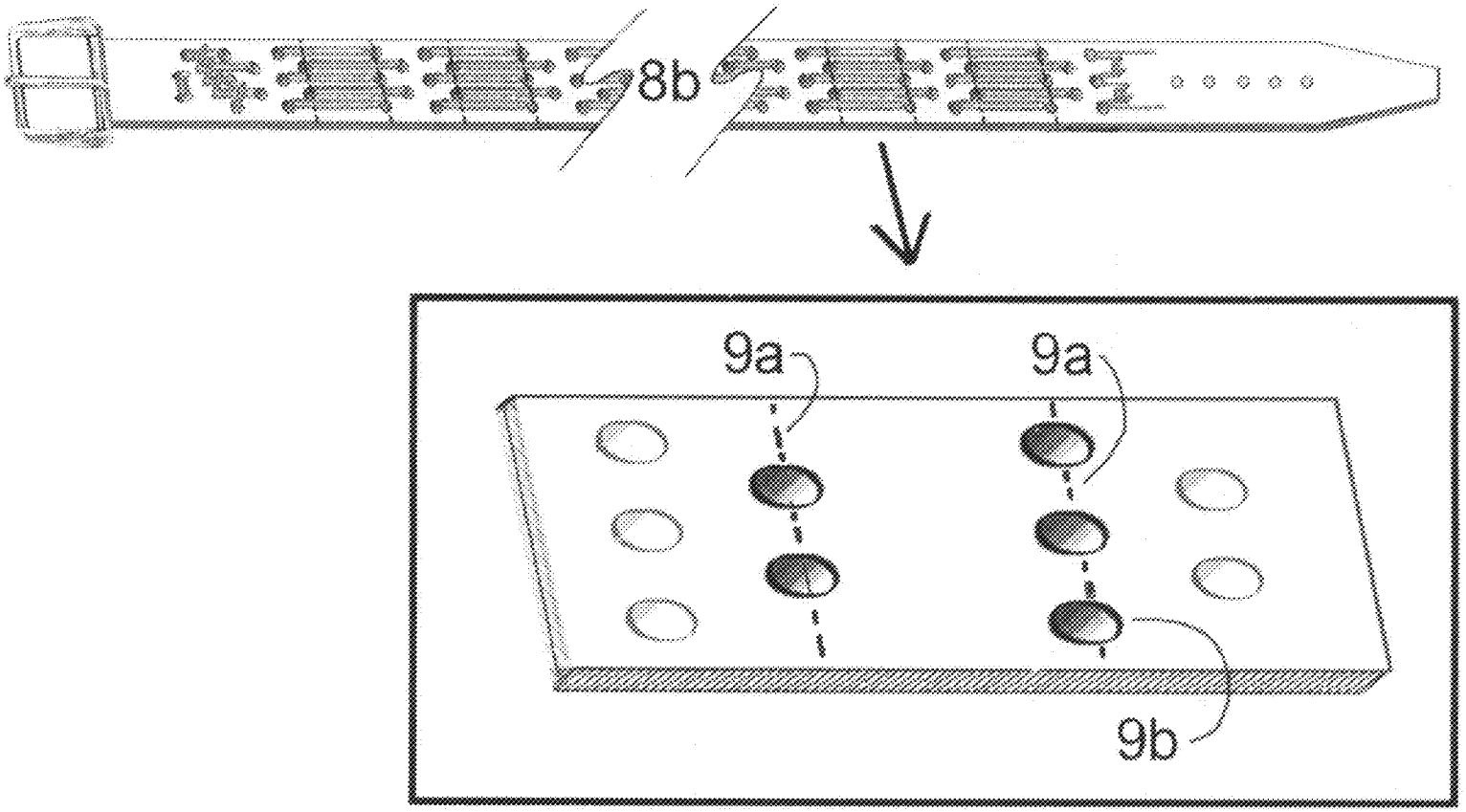
FIG. 9 shows the embodiment of this article as a belt containing pockets created between layers of the carrier material.

Another belt embodiment is shown in FIG. 9. In this embodiment the flexible carrier 1*a* can comprise two or more layers, optionally of material containing layers stuck together, and the layers can be arranged or parted partially so that small voids, pockets, are created between layers. These voids or pockets have at least three sides; one side being created on or near the bottom by the carrier itself, and one on each side created by the flexible carrier or stitching 9*a* and/or hole reinforcements 9*b*. The hole reinforcements may comprise, but are not limited to, grommets and/or shoe eyelets. As FIG. 9 shows, cordage is laced or woven through the flexible carrier 1*a* in the fashion described above, however the distance between the holes may be longer than in other embodiments. In this embodiment the width of the void/pocket is usually no less than 1.5 inches, and usually no more than 3 inches. The carrier material may or may not form a fourth side to the "pocket". These pockets may be used to carry relatively flat objects such as matches, a small knife, a compass, money, and other useful items that the user may find advantageous to have with them whenever wearing a belt. Such items, the "belt" and cordage thus comprise a "mini-survival kit" or "emergency kit". Furthermore, since these items are hidden from view by the carrier material, and their shape is obscured by the cordage, they can be carried in a discreet or covert manner.

Hole reinforcements may also be used to regulate friction between the carrier and cordage where resistance to cordage deployment is desired to lower a person or heavy things down a steep slope or down vertically, and also to prevent wear of the holes in the flexible carrier material.

Figure 10:
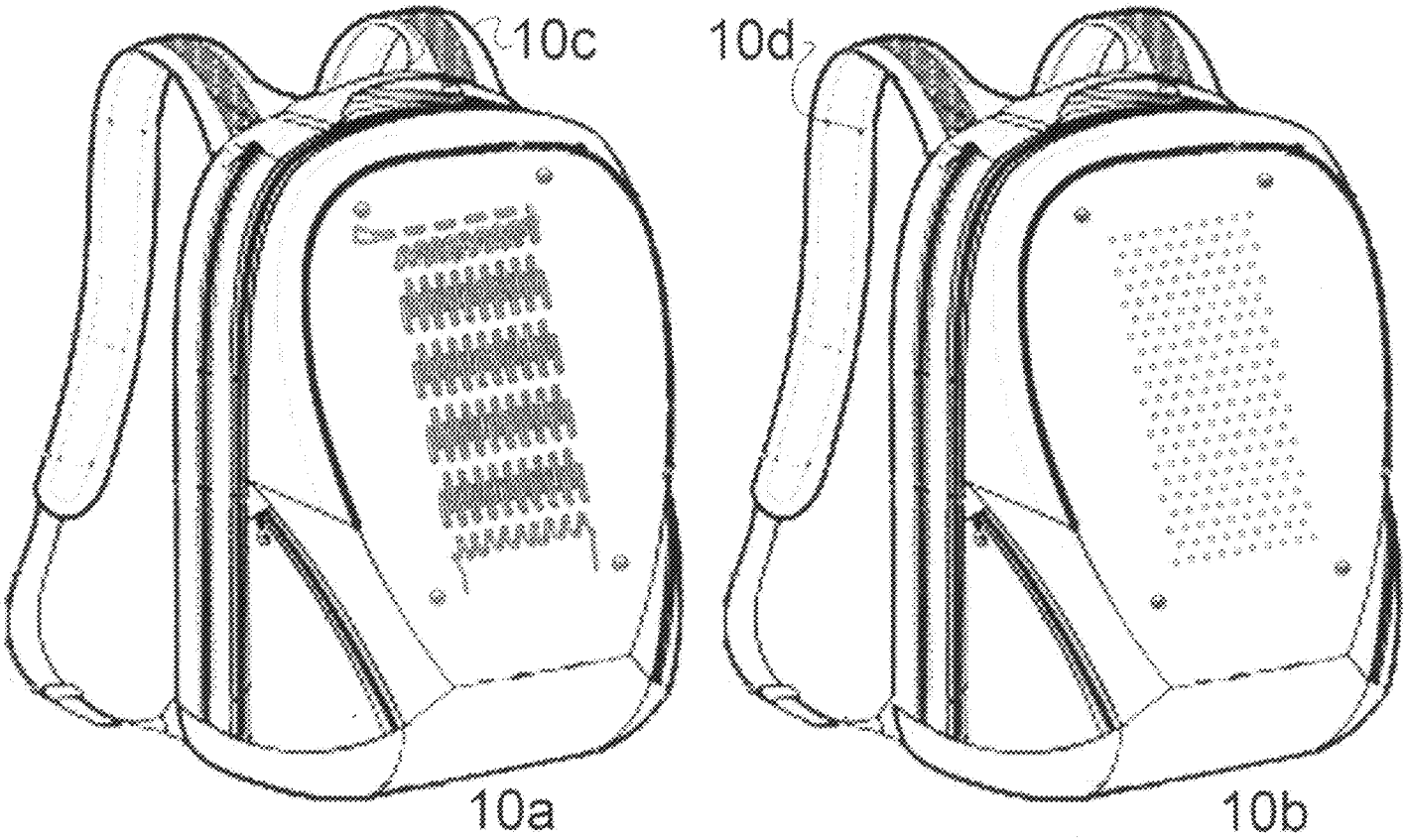
FIG. 10 shows the embodiment of this article as a panel of a backpack
Figure 11:
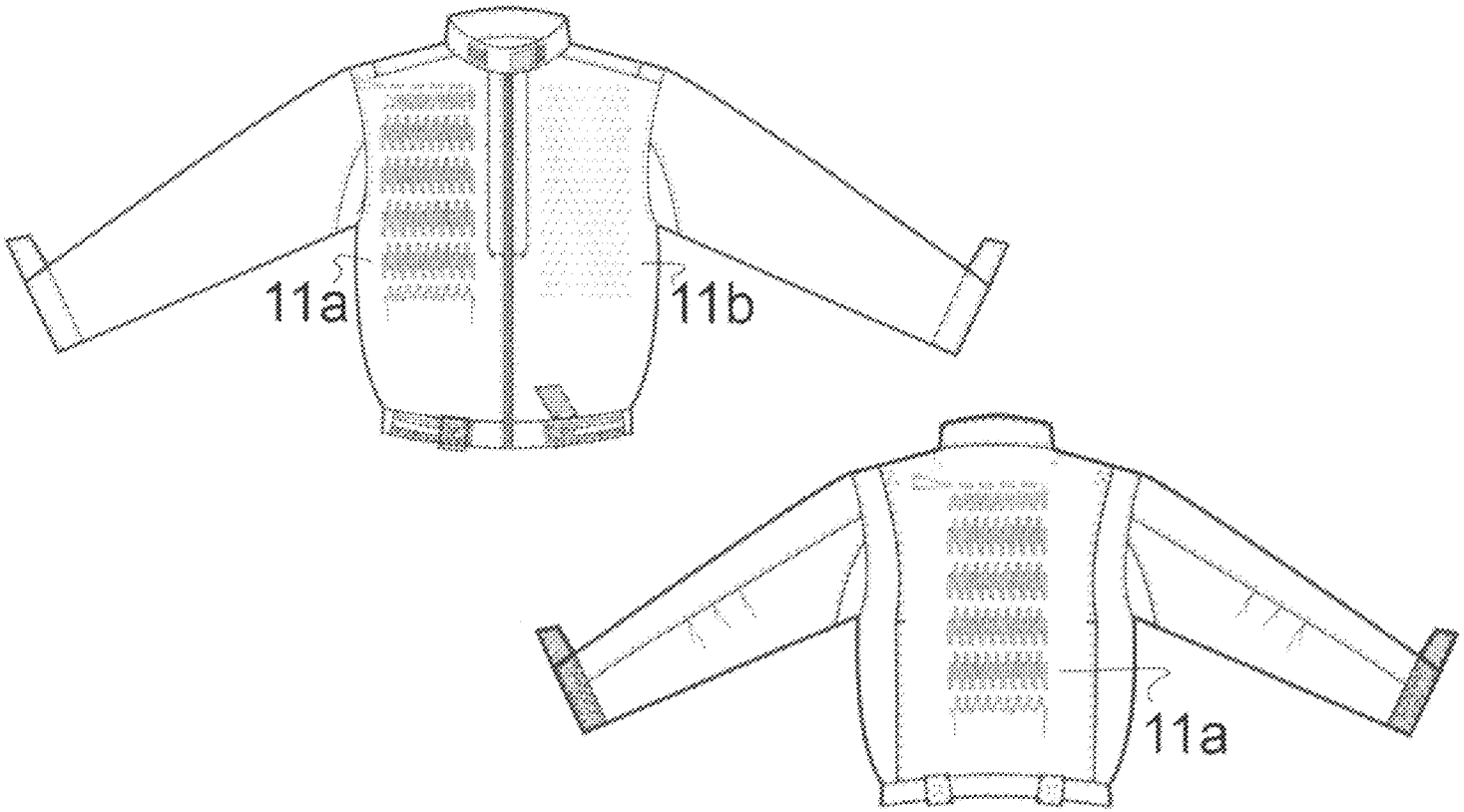
FIG. 11 shows the embodiment of this article as panel of a jacket.

The cordage storage article of the invention can also be a panel of flexible material that can be incorporated as a panel in or as part a bag, backpack, jacket and/or vest. FIG. 10 illustrates an embodiment where such a panel is incorporated in a backpack, with the cordage packed 10*a*, and empty 10*b*. Also, the belts or straps of the backpack 10*c* and 10*d* can be used to store cordage according to the invention. Similarly, FIG. 11 shows an embodiment as panels in a jacket, shirt, vest, etc. FIG. 11 shows packed panels 11*a* on the front and on the back of a jacket or shirt, and with removable arms could be on a vest, etc., and 11*b* shows an empty front jacket panel.

Figure 12:
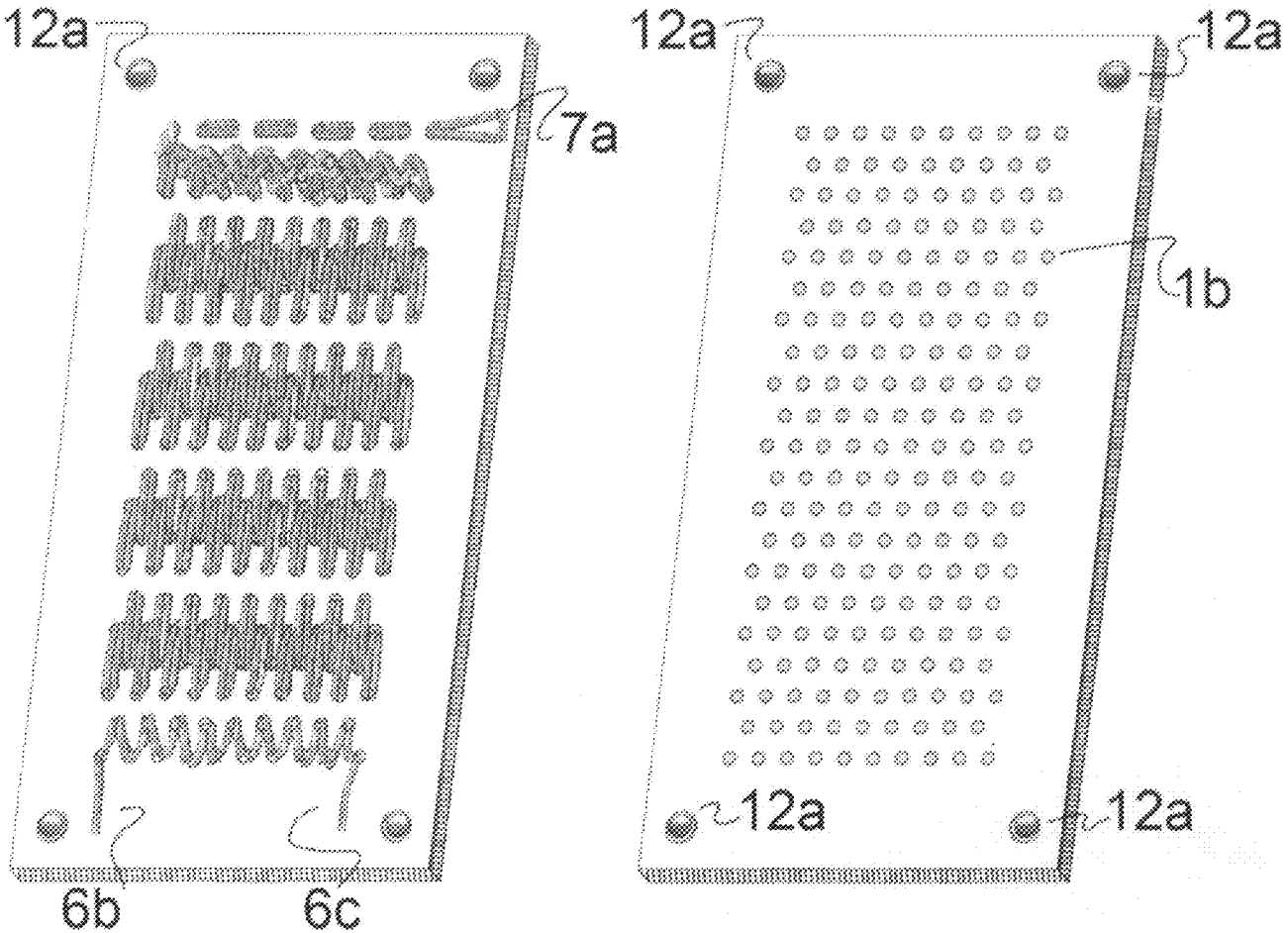
FIG. 12 shows the embodiment of this article as a detachable panel.

The flexible cordage storage article of the invention can also function as a panel that can be attached to or incorporated in other items, e.g. as shown in FIG. 12. To facilitate attachment of the panel carrier reinforcements 12*a* (e.g., grommets) are located in all four corners. Thus the panel can be attached to the exterior of a backpack or garment, or alternatively simply packed into a backpack or suitcase. The cordage is protected from unraveling or becoming entangled in itself or other objects by virtue of it being woven into the carrier 1*a* and the loop end 7*a* and/or final end 3*b* being secured as described above.

A larger version of this panel can be used with thicker ropes (8 mm and thicker) to neatly store and transport cordage used in climbing. By securing the panel to a stationary object the user can deploy the cordage at a predictable rate once the degree of friction between the cordage and holes has been established. Hole diameters or hole reinforcements 9*b* (FIG. 9) can be used to regulate said friction.

Figure 13:
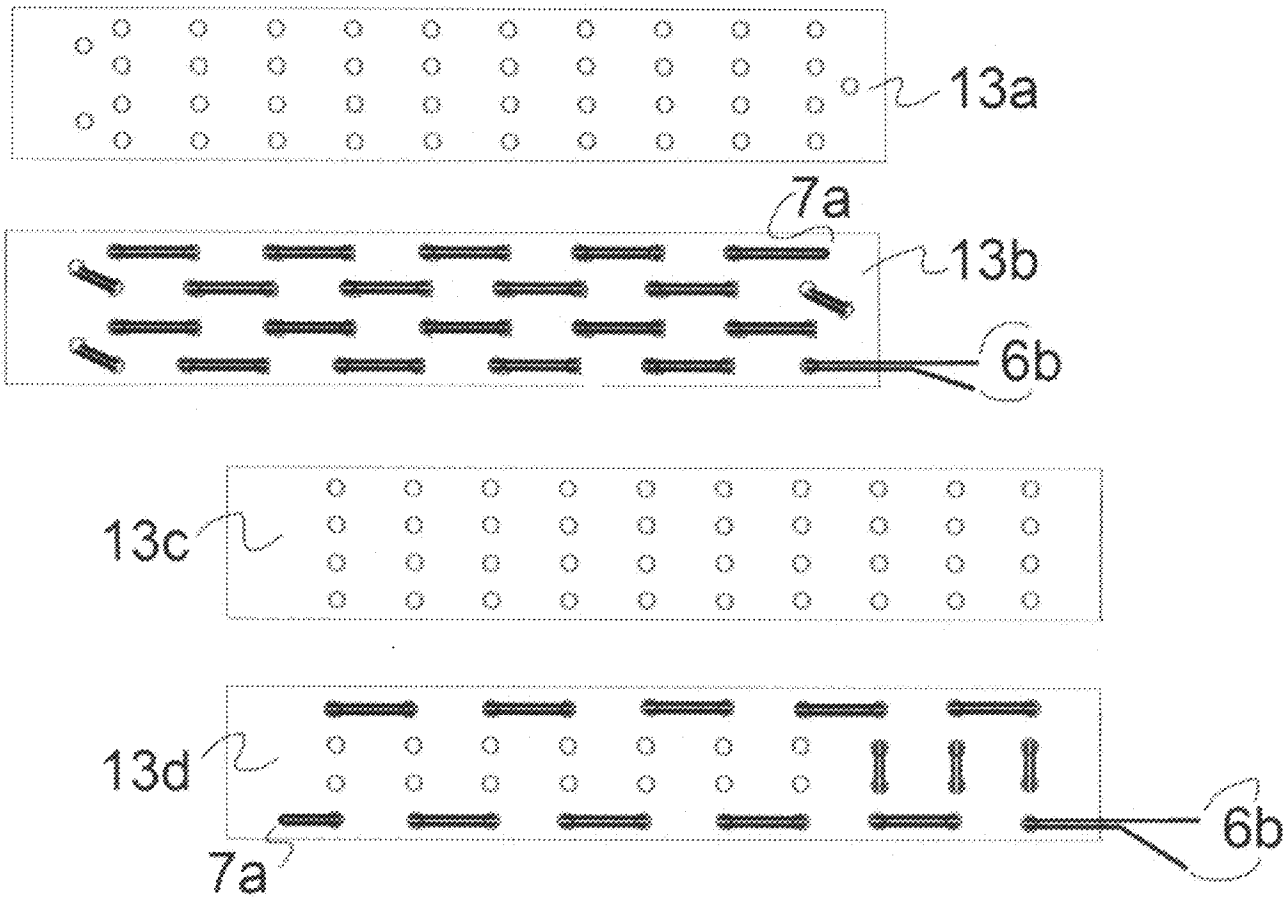
FIG. 13 shows two alternative hole patterns.

Many patterns of holes can be used for the arrangement or plurality of holes in the flexible carrier. Two such patterns of many that will be obvious upon studying this disclosure are shown in FIGS. 13 as 13*b* and 13*d*, showing packed cordage and empty flexible carriers 13*a* and 13*c*.

Figure 14:
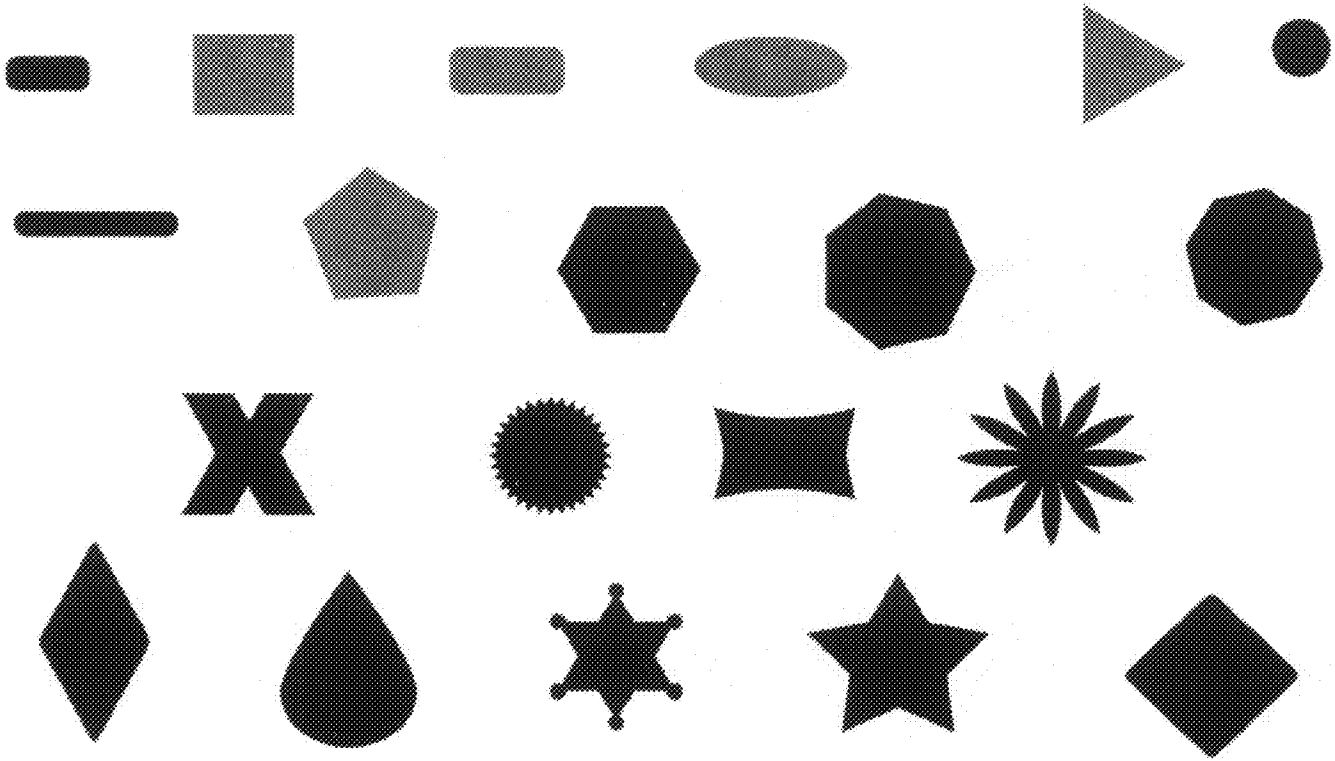
FIG. 14 shows some, but not all of the possible shapes for holes that can be used in the embodiments disclosed.

Likewise, a variety of shapes can be used in the embodiments disclosed in this application. A sampling of these shapes is provided on FIG. 14. Not all possible shapes and sizes that are suitable are shown. Additionally, combinations of two or more hole shapes may be used in a single embodiment to provide the desired cordage storage and deployment characteristics. Hole shapes and hole patterns may be different than those disclosed in this application as some hole shapes and sizes may accommodate more or less cordage than others.

Different embodiments employing the concept and teachings of the invention will be apparent and obvious to those of ordinary skill in this art and these embodiments are likewise intended to be within the scope of the claims. The inventor does not intend to abandon any disclosed inventions that are reasonably disclosed but do not appear to be literally claimed below, but rather intends those embodiments to be included in the broad claims either literally or as equivalents to the embodiments that are literally included.

The invention claimed is:

1. An article for storing a strand of cordage comprising:

a) a flexible carrier, b) the flexible carrier being a cordage holder having one of more function(s) selected from a group consisting of a belt, a bandolier, an article of clothing, a handle or shoulder strap for luggage, a backpack, a carry storage container, a free-standing panel that may be attached to or contained in a backpack or carry storage container, a piece of luggage and any combination thereof in addition to that of a cordage holder, said function(s) remaining after the cordage is removed from the flexible carrier, c) having at least thirty or more spaced apart holes therein arranged in a plurality of rows, and a single length of cordage laced through at least most of the holes in the plurality of holes in the flexible carrier, the single length of cordage being in the form of a tightly looped double strand of said single length of cordage, and d) said single length of cordage being laced through at least some of the holes in the plurality of holes, such that loop ends of the tightly looped double strand of the single length of cordage farthest from the hole into which said cordage is initially inserted into the flexible carrier are all on the same exterior surface of the flexible carrier at the last or next to last row of holes in the flexible carrier farthest from the hole into which the cordage is initially inserted, and e) the cordage being temporarily secured from pulling through one or more of the holes in the plurality of holes by inserting at least one of the loop ends of the tightly looped double strands of the single length of cordage into at least one other loop end of said double strand of the single length of cordage, and f) one or more temporary securements for the ends of the cordage, optionally using a piece of hardware or other mechanical device, g) whereby the single length of cordage is difficult to become tangled when held in the flexible carrier, and said cordage is also easily, rapidly and completely removable by removing the temporary securement(s) when present and pulling on an end of the strand of the single length of cordage, h) the diameter of the holes and the laced double strand of the single length of cordage being such that the force required to pull all of the single length of cordage from the flexible carrier being in the range of 2 to 25 Newtons.

2. The cordage storage articles of claim 1 wherein the flexible carrier is all or a part of clothing and at least one of the additional function(s) remains while the single strand of cordage is being removed from the flexible carrier.

3. The cordage storage article of claim 1 wherein the flexible carrier is all or part of a piece of a carry storage container, selected from the group consisting of a back-pack, a duffel bag, a valise, a satchel, a duffel bag, a bag having one or two handles, or any combination thereof.

4. The cordage storage article of claim 1 wherein the flexible carrier comprises one or more layers, the layer or layers comprised of a material selected from a group consisting of leather, artificial leather, a polymer, mylar, vinyl, plastic, woven fabric, nonwoven fabric, skrim, and combinations of two or more of such materials and/or layers.

5. The cordage storage article of claim 2 wherein the flexible carrier comprises one or more layers, the layer or layers comprised of a material selected from a group consisting of leather, artificial leather, a polymer, mylar, vinyl, plastic, woven fabric, nonwoven fabric, skrim, and combinations of two or more of such materials and/or layers.

6. The cordage storage article of claim 3 wherein the flexible carrier comprises one or more layers, the layer or layers comprised of a material selected from a group consisting of leather, artificial leather, a polymer, mylar, vinyl, plastic, woven fabric, nonwoven fabric, skrim, and combinations of two or more of such materials and/or layers.

7. The cordage storage article of claim 1 wherein at least some of the holes in the plurality of holes have a shape selected from the group consisting of a circle, any part of a circle, a square, a rectangle, a triangle, a slot, a keyhole, a racetrack (two generally parallel sides with rounded ends), and any combination of such shapes.

8. The cordage storage article of claim 2 wherein at least some of the holes in the plurality of holes have a shape selected from the group consisting of a circle, any part of a circle, a square, a rectangle, a triangle, a slot, a keyhole, a racetrack, and any combination of such shapes.

9. The cordage storage article of claim 3 wherein at least some of the holes in the plurality of holes have a shape selected from the group consisting of a circle, any part of a circle, a square, a rectangle, a triangle, a slot, a keyhole, a racetrack, and any combination of such shapes.

10. The cordage storage article of claim 4 wherein at least some of the holes in the plurality of holes have a shape selected from the group consisting of a circle, any part of a circle, a square, a rectangle, a triangle, a slot, a keyhole, a racetrack, and any combination of such shapes.

11. The cordage storage article of claim 5 wherein at least some of the holes in the plurality of holes have a shape selected from the group consisting of a circle, any part of a circle, a square, a rectangle, a triangle, a slot, a keyhole, a racetrack, and any combination of such shapes.

12. The cordage storage article of claim 6 wherein at least some of the holes in the plurality of holes have a shape selected from the group consisting of a circle, any part of a circle, a square, a rectangle, a triangle, a slot, a keyhole, a racetrack, and any combination of such shapes.

13. A flexible belt having a) at least thirty or more spaced apart holes therein arranged in a plurality of rows, and b) a single length of cordage, being in the form of a tightly looped double strand of said length of cordage running thought at least most of the holes forming loops of cordage that lay close to the flexible carrier, and c) said single length of cordage being laced through at least some of the holes in the plurality of holes, such that loop ends of the tightly looped double strand of the single length of cordage farthest from the hole into which said cordage is initially inserted into the flexible carrier are all on the same exterior surface of the flexible carrier at the last or next to last row of holes in the flexible carrier farthest from the hole into which the cordage is initially inserted, and d) the cordage being temporarily secured from pulling through one or more of the holes in the plurality of holes by inserting at least one of the loop ends of the tightly looped double strands of the single length of cordage into at least one other loop end of said double strand of the single length of cordage.

14. The flexible belt of claim 13 having a buckle on at least one end portion of the flexible belt and being of a width to pass through belt loops on an article of clothing.

15. A method of making a cordage storage device comprising, a) selecting a flexible carrier for the cordage carrier, from a group consisting of a belt, a bandolier, an article of clothing, a handle or shoulder strap for luggage, a backpack, a carry storage container, a free-standing panel that may be attached to or contained in a backpack or carry storage container, a piece of luggage and any combination thereof, b) said flexible carrier having at least thirty or more spaced apart holes therein arranged in a plurality of rows, and c) the flexible carrier having one or more function(s) in addition to being a cordage to being a cordage holder, said function(s) remaining after the cordage is removed from the flexible carrier, and d) lacing a single length of cordage being in the form of a tightly looped double strand of said single length of cordage though at least some of the holes in the plurality of holes such that loops of cordage are formed between any two holes, the loops lying close to an exposed surface of the flexible carrier, and e) lacing said single length of cordage through at least some of the holes in the plurality of holes, such that loop ends of the tightly looped double strand of the single length of cordage farthest from the hole into which said cordage is initially inserted into the flexible carrier are all on the same exterior surface of the flexible carrier at the last or next to last row of holes in the flexible carrier farthest from the hole into which the cordage is initially inserted, and f) securing the cordage temporarily from pulling through one or more of the holes in the plurality of holes by inserting at least one of the loop ends of the tightly looped double strands of the single length of cordage into at least one other loop end of said double strand of the single length of cordage, and g) optionally securing an end of the cordage temporarily from pulling through one or more of the holes in the plurality of holes using a piece of hardware or other mechanical device.

16. The method of claim 15 wherein the flexible carrier selected is all or a part of an article of clothing and wherein at least one of the additional function(s) remains while the cordage is being removed from the flexible carrier.

17. The method of claim 15 wherein the flexible carrier selected is all or part of a piece of a carry storage container, selected from the group consisting of a back-pack, a duffel bag, a valise, a satchel, a bag having one or two handles, or any combination thereof.

18. The method of claim 15 wherein the flexible carrier selected comprises one or more layers, the layer or layers comprised of a material selected from a group consisting of leather, artificial leather, a polymer, mylar, vinyl, plastic, woven fabric, nonwoven fabric, skrim, and combinations of two or more of such materials and/or layers.

19. The method of claim 15 wherein at least some of the holes in the plurality of holes have a shape selected from the group consisting of a circle, any part of a circle, a square, a rectangle, a triangle, a slot, a keyhole, a racetrack (two generally parallel sides with rounded ends), and any combination of such shapes.

20. The method of claim 19 wherein the hole shape is a racetrack.

* * * * *